US005699743A

United States Patent [19]

Ganz et al.

[11] Patent Number: 5,699,743

[45] Date of Patent: Dec. 23, 1997

[54] COMPOSITION AND METHOD FOR RAISED THERMOGRAPHIC PRINTING

[76] Inventors: Leonard R. Ganz, 16 Country Club Way, Demarest, N.J. 07627; Anthony F. Urgola, 2630 River Rd., Manasquan, N.J. 08736

[21] Appl. No.: 649,430

[22] Filed: May 17, 1996

[51] Int. Cl.[6] ..... B05D 5/00; B05D 5/02

[52] U.S. Cl. ..... 101/488; 427/197; 427/202; 427/270

[58] Field of Search ..... 101/488; 427/197, 427/270, 202

[56] References Cited

U.S. PATENT DOCUMENTS

| | | | |
|---|---|---|---|
| 1,739,492 | 12/1929 | Berndt et al. | 427/195 |
| 3,911,160 | 10/1975 | Neuberg | 427/27 |
| 3,924,019 | 12/1975 | Jacob | 427/14 |
| 3,945,934 | 3/1976 | Jacob | 252/62.1 |
| 4,079,673 | 3/1978 | Bernstein | 101/426 |
| 4,101,688 | 7/1978 | Kurtzman | 427/56 |
| 4,254,163 | 3/1981 | Piazza | 427/96 |
| 4,380,597 | 4/1983 | Erwied et al. | 524/109 |
| 4,421,814 | 12/1983 | Piazza | 428/195 |
| 4,459,344 | 7/1984 | Jacob | 430/97 |
| 4,540,644 | 9/1985 | Jacob | 430/110 |
| 5,098,739 | 3/1992 | Sarda | 427/197 |
| 5,126,186 | 6/1992 | Cheek | 428/195 |
| 5,138,027 | 8/1992 | Van Beek | 528/339.3 |
| 5,219,622 | 6/1993 | Meier | 427/466 |

*Primary Examiner*—Edgar S. Burr
*Assistant Examiner*—Leslie Grohusky
*Attorney, Agent, or Firm*—Pennie & Edmonds LLP

[57] ABSTRACT

The present invention relates to a product having raised thermographic print and a method for making the same. The product relates to a raised thermographic product having raised thermographic print greater than about 0.01 inches. The method includes preparing a large granulation powder, printing a wet ink line on a sheet for receiving the large granulation powder, placing a sufficient amount of the large granulation powder on the wet ink line to provide a desired height to the raised thermographic product, removing a sufficient amount of large granulation powder from the sheet to avoid a blurred thermographic product, while leaving a sufficient amount in contact with the ink line to provide the desired height, heating the sheet over an amount of time sufficient to melt and fuse the large granulation powder, yet insufficient to cause overmelting or flattening, and cooling the fused large granulation powder sufficiently to avoid flattening, sticking, or smearing of the fused powder, thereby obtaining a raised thermographic product greater than about 0.01 inches in height.

11 Claims, 1 Drawing Sheet

COMPOSITION AND METHOD FOR RAISED THERMOGRAPHIC PRINTING

FIELD OF THE INVENTION

The present invention relates to a thermographic printing process for producing a printed article or product having raised thermographic print which is greater than about 0.01 inches in size. To achieve this product, a generally larger granulation polymer powder is used in a precisely controlled process. The process as well as the large granulation size powder and the resulting products all form part of the present invention.

BACKGROUND OF THE INVENTION

Many printers have discovered that thermography adds another dimension to their business. Thermography today is no longer just for stationery, business cards and announcements. Thermography is emerging as an art form in its own right. Used on its own, or as an adjunct to lithography, foil stamping, embossing and silk screening, it has become an extremely useful tool for graphic designers and artists. Other applications include greeting cards, labels, tags, annual reports, report covers, packaging and posters.

Thermography is an established procedure whereby raised printing that imitates copper plate engraving or stamping from any type of printing process is more easily accomplished using an offset or other conventional printing process. Printed sheets from a conventional printing press drop onto a conveyer where a resin or powder, having the characteristic of melting under the effect of heat, is vibrated onto them. Excess powder may be continuously removed by vacuum suction and recycled, except where it has adhered to the wet ink. The printed and powdered sheet then passes through a tunnel oven, where it is heated to melt and fuse the powder thereby making it swell. At the exit, cold air is blown onto the sheet to cool and set the viscous raised film so as to prevent sheets from sticking together or smearing. One example of such a thermographic printing procedure is U.S. Pat. No. 5,098,739 to Sarda.

It is known in the art that the granule size of the powder used determines the thickness of the relief film, or raised print, up to a certain maximum height. The thicker the powder and the larger the granules, the greater the height of the raised print. The largest conventional raised print is a maximum of 0.003 inches in height, which is achieved using a 60 mesh over 80 mesh size to produce the appropriate granulation.

There are two distinct types of thermographic powder generally used: transparent and opaque. Transparent powders generally include high gloss, semi-gloss, and semi-dull. Opaque powders typically include metallics, such as gold, silver, and bronze; white; and the relatively new pearlized powder. High gloss is the most commonly used powder for all thermographic applications.

There are five conventional granulations for use on lines ranging in thickness from "fine line" to "heavy solids." Fine lines require the finest granulation typically described as fine as flour, while heavy solids require a coarser granulation typically described as loose as sugar. Semi-gloss, dull and semi-dull powders are primarily selected by designers looking for special effects. They generally provide less shine than the high gloss powders, but retain a similar "feel" and raise. The metallic and white opaque powders, on the other hand, are typically difficult to work with. Thus, thermography shops generally run only high gloss powders.

SUMMARY OF THE INVENTION

The present invention includes a method of making a raised thermographic product including preparing a large granulation powder, printing a wet ink line on a substrate, such as a paper sheet, for receiving the large granulation powder, placing a sufficient amount of the large granulation powder on the wet ink line to provide a desired height to the raised thermographic product, removing a sufficient amount of large granulation powder from the substrate to avoid a blurred thermographic product while leaving a sufficient amount in contact with the ink line to provide the desired height, heating the substrate over an amount of time sufficient to melt and fuse the large granulation powder, yet insufficient to cause overmelting or flattening, and cooling the fused large granulation powder sufficiently to avoid flattening, sticking, or smearing of the fused powder, thereby obtaining a raised thermographic product greater than at least 0.01 inches in height.

In one embodiment, the large granulation powder preparation step further includes selecting the particles to be at least about 20 mesh to 50 mesh size. In another embodiment, the printing step further includes printing the ink line width to be about 1/16 to 1/8 inch. In another embodiment, the heating step further includes heating the substrates to about 350° F. to 450° F. In yet another embodiment, the heating step further includes heating each substrate for about 0.75 to 1.2 seconds. In another embodiment, the cooling step further includes cooling the sheets below about 200° F.

Another aspect of the invention relates to a raised thermographic product which includes a substrate having thereon raised thermographic print which is greater than about 0.01 inches in height. The substrate is typically a sheet of paper and the print can be applied thereon according to the above-described method.

In one embodiment of the product, the raised thermographic product further includes a melted and fused large granulation powder having particles of at least about 20 mesh to 50 mesh size. In another embodiment of the raised thermographic product, the product further has raised thermographic print of about 1/16 to 1/8 inches in width. Typical substrates of such products include paper, cardboard or the like.

BRIEF DESCRIPTION OF THE DRAWINGS

A better understanding of the present invention may be obtained by reviewing the following descriptions, which describe preferred embodiments and wherein.

DETAILED DESCRIPTION OF THE INVENTION

Figure 1:
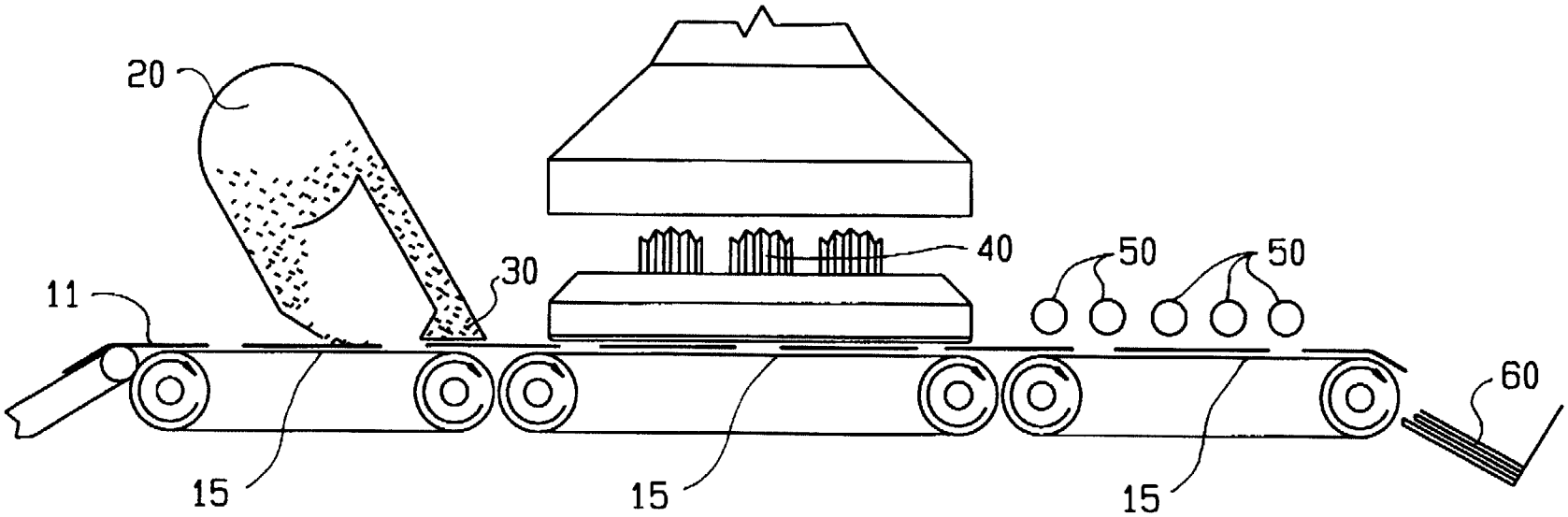
FIG. 1 illustrates the equipment used in the raised thermographic printing process according to the present invention.

The present invention includes raised printed borders that facilitates coloring with a crayon or water color pen, shading a sketch, and the like, while remaining within the borders of the higher than normal raised lines which form a border outline. This is advantageously accomplished by use of a larger than normal granulation size resin or polymer powder. In addition, the line design must meet specified standards to avoid flattening, peeling, or other undesirable effects upon fusing of the powder. Other important features of the present invention are the powder application phase, the vacuum suction phase, and the length and temperature of the tunnel oven for heating and fusing the large granulation thermographic powder.

Although it is preferred that a polyamide resin be used, any polymer or resin powder suitable for printing that has a melting point of at least about 115° C. (about 240° F.) may be utilized. The resin is generally available in particle sizes which are much too fine for use in the present invention. Thus, larger size resin chunks or pellets are obtained for grinding into a powder of the desired granulation size. The powder making process involves mixing a lubricant with polyamide resin. This resin is generally available pelletized, and is available as VERSAMID 1655 from Henkel Corporation, Ambler, Pa.

Any resin or powder suitable for thermographic printing that is of sufficient size may be substituted in the present invention, although a polyamide resin is preferred. The pellets must be at least about ¼ inch square, as anything less would result in the powder being too small subsequent to grinding for the raised thermographic print of the present invention. The lubricant is preferably a carboxylic acid or polyol, and is useful for grinding the resin pellets down to particles of the desired size. These carboxylic acids include fatty acids, such as lauric acid, myristic acid, palmitic acid, stearic acid, and behenic acid. It is more preferred that the lubricant be a stearate or stearate derivative, such as calcium stearate, pentaerythrityl stearate, palmitoylsteroyl methane, or stearoylbenzoyl. In a most preferred embodiment, zinc stearate is used as the lubricant. Some of the suitable carboxylic acid and polyol lubricants are taught in U.S. Pat. No. 4,380,597 to Erweid et al., the teachings of which are expressly incorporated herein by reference thereto.

The polyamide pellets are chopped, or ground, then sifted by use of special large mesh screens. The present invention advantageously uses a 20 mesh over 50 mesh size, more preferably 22 mesh over 45 mesh, and most preferably 25 mesh over 40 mesh, to produce the large granulation size required to form the high raised print of the present invention. This beneficially provides a print that is greater than about 0.01 inches in height above the paper, which is approximately three times that of conventional thermographic raised printing. Following the sifting, the polyamide and stearate powder are mixed in a high intensity mixer with an anti-static agent such as Neustat Concentrate 53, which is available from Simco, Hatfield, Pa. Any suitable anti-static agent may be easily substituted by one skilled in the art. A final sifting is used to remove any remaining impurities, thereby rendering a powder ready for use in the formation of raised thermographic print.

Any offset or letterpress equipment (not shown) is suitable for use in raised thermographic printing according to the present invention. Offset equipment is preferred because of the slower speed and the reduced image sharpness on soft papers when using letterpress equipment. Hot type and zinc or magnesium plates may leave a rough, jagged edge on the printed image that may magnify when powder is applied to the wet ink and heated in the process when using letterpress equipment. An offset duplicator or press, such as A. B. Dick or Multigraphic, with a chute delivery is preferred for thermography over a press with chain delivery, although either is suitable for the present invention. The chute delivery equipment is preferred due to the enhanced fit between the equipment-press to thermography-conveyor with the chute delivery.

The thermographic process of the present invention begins with the printed sheet 11 that has just left the printing press. The sheet 11 drops onto the thermographic conveyor 15, while the ink just laid down is still tacky. If rubbed, the ink would smear. A sharp ink line of about 1/16 to ⅛ inch is required by the present invention. Conventional raised thermographic printing generally uses much thinner or wider ink bands, as there is no need for the narrow bands of the present invention to achieve a conventional raised print of about 0.003 inches. The ink line of the present invention is preferably sharp and well-defined, as discussed above, as this ultimately produces a smoother raised print. A more narrow ink line results in a minimal height to the raised print, because the inked line cannot pick up and retain the large granulation powder. Upon fusing, there will be an undesirably insufficient amount of powder left on the ink to produce raised print of the desired height. An ink line that is broader than about ⅛ inch results in an "orange peel" effect when the large granulation powder is heated and fused, undesirably leading to a raised print that has a rough, rather than smooth, finish.

Following the offset printing, the wet ink sheet then passes under a shaker 20 or other similar device that delivers the large granulation powder over the full sheet and agitates the powder over the full sheet. The powder adheres to the wet, tacky ink. The powder application is an important phase of the raised thermographic printing process, but one of ordinary skill can determine the appropriate amount of powder to apply to the sheet by routine experimentation after placing the correct line width thereon. Too little powder produces an uneven coverage and a poor raise in the printing, while too much powder will result in the powder spilling over the inked lines as it melts, thus creating a sloppy border.

The excess large granulation powder that does not adhere to the ink is suctioned off the sheet by vacuum suction 30 or other suitable means. This excess powder is recycled back into the shaker system for reuse. The vacuum suction 30 is another important phase of the raised thermographic print process. When the sheet passes beneath the vacuum combs, too little suction would leave excess powder on the full sheet. This results in undesired effects and leaves the final product with an undesirably gritty, sandy feel. Too much suction results in too little powder on the sheet, which leads to the same undesirable effects discussed above when too little powder is initially agitated onto the sheet. Again, through routine experiment a craftsman in the art will arrive at the appropriate amount of vacuum suction.

After the vacuum suction, the sheet is carried into a heat tunnel 40. This tunnel 40 heats the sheet and sets up the powder. Conventional thermographic processes use tunnels of about 4 feet in length. The industry trend has been to use shorter tunnel ovens at higher temperatures to make the equipment more compact. Such tunnels are undesirable for the present invention, because a long, low heat is desired to produce the raised thermographic print according to the present invention. The amount of heat applied is another important factor in this process. The heat tunnels 40 of the present invention are at least about 5 feet, and are more preferably at least about 6 feet.

The critical tunnel length is designed to permit application of the appropriate amount of heat for the appropriate length of time, thereby resulting in a heat tunnel 40 that melts all the powder without overmelting the powder. The powder is preferably heated enough to melt entirely, yielding a smooth highly raised print. Too much heat, on the other hand, will cause the powder to overmelt and liquefy, resulting in a raised print which is much flatter and more blurry than that desired. Other problems associated with overheating are loss of paper moisture that results in a brittle sheet, as well as burning of the sheet when the heat is very intense. A craftsman will be able to arrive at the appropriate amount of heat through routine experimentation.

Additional heat may be desired should it become desirable to operate the printing and thermographic machinery faster than usual, e.g., to handle greater volume production. In this embodiment, the tunnel may be lengthened to provide heat for a longer time period without altering the heating temperature. In another, more preferred embodiment for additional heat, the conveyor may form a U-shape so that it returns the sheets after leaving the cooling unit, thereby achieving additional cooling time.

Heat is typically provided by electricity, although gas or any other suitable means of heating an oven may be substituted. Conventional tunnel ovens are heated to about 800° F., which is undesirably hot for the purposes of the present invention as it would cause the resin to overmelt. The heat tunnel 40 of the present invention is preferably heated to about 350° F. to 450° F., more preferably to about 355° F. to 425° F., and most preferably to about 360° F. to 400° F.

On typical offset equipment, over 5,000 sheets per hour may be processed, although this figure may be adjusted either upward or downward as desired. The heating step limits the overall speed of the process to produce the raised thermographic product of the present invention. About 50 to 80 sheets per minute, more preferably about 60 to 79 sheets per minute, and most preferably about 70 to 78 sheets per minute, for an 11 inch letter size sheet is typically fed through the heater 40 in the present invention. In a 6 foot tunnel oven, the sheets would feed through the tunnel oven at about 8 to 13 sheets per minute per foot of tunnel, more preferably about 10 to 13 sheets per minute per foot of tunnel, and most preferably about 12 to 13 sheets per minute per foot of tunnel. In a 6 foot tunnel oven, each sheet typically spends about 0.75 to 1.2 seconds, more preferably about 0.75 to 1 seconds, and most preferably about 0.75 to 0.9 seconds, in the tunnel oven for heating.

Once through the heat tunnel 40, the sheet continues on the conveyor 15 for about six more feet to permit cooling of the raised print, thereby avoiding sticking of the sheets, and flattening or smearing of the raised print. The temperature is preferably lowered well below 200° F., the melting point of the large granulation powder or resin. The length may vary, depending on the speed of the conveyor 15, the size of the sheets, the temperature of the heat tunnel, and the specific large granulation powder used. Above the conveyor, there are metal tubes 50, fans, or the like to blow air directly onto the sheet. The finished sheets 11 are automatically stacked at the end of the conveyor 15 and jogged into stacks on a receiving tray 60 or the like using conventional equipment or a return U-shaped conveyor to achieve additional cooling time.

It will be understood that generally recognized good engineering and chemistry practice will be observed during the selection of proper components for the powder composition and raised thermographic printing process without departing from the present invention.

Although preferred embodiments of the invention have been described in the foregoing Detailed Description of the Invention, it will be understood that the invention is not limited to the embodiments disclosed but is capable of numerous modifications without departing from the spirit and scope of the present invention. It will be understood that the chemical and mechanical details may be slightly different or modified by one of ordinary skill in the art without departing from the methods and compositions disclosed and taught by the present invention.

What is claimed is:

1. A method of making a raised thermographic product comprising the steps of:

preparing a large granulation powder having a particle size of about 20 to 50 mesh;

printing a wet ink line having a width of about 1/16 to 1/8 inch on a substrate for receiving the large granulation powder;

placing a sufficient amount of the large granulation powder on the wet ink line to provide a desired height to the raised thermographic product;

removing a sufficient amount of large granulation powder from the substrate to avoid a blurred thermographic product, while leaving a sufficient amount in contact with the ink line to provide the desired height;

heating the substrate over an amount of time sufficient to entirely melt and fuse the large granulation powder to yield a smooth surface, yet insufficient to cause flattening of the large granulation powder; and cooling the fused large granulation powder sufficiently to avoid flattening, sticking, or smearing of the fused powder, thereby obtaining a raised thermographic product greater than at least 0.01 inches in height.

2. The method of claim 1, wherein the heating step further comprises heating the substrate to about 350° F. to 450° F.

3. The method of claim 1, wherein the heating step further comprises heating the substrate for about 0.75 to 1.2 seconds.

4. The method of claim 1, wherein the cooling step further comprises cooling the substrate below about 200° F.

5. The method of claim 1, which further comprises selecting the substrate to be paper.

6. A raised thermographic product comprising a substrate having raised thermographic print thereon which is greater than 0.01 inches in height and which is produced by a method comprising the steps of:

preparing a large granulation powder having a particle size of about 20 to 50 mesh;

printing a wet ink line having a width of about 1/16 to 1/8 inch on a substrate for receiving the large granulation powder;

placing a sufficient amount of the large granulation powder on the wet ink line to provide a desired height to the raised thermographic product;

removing a sufficient amount of large granulation powder from the substrate to avoid a blurred thermographic product, while leaving a sufficient amount in contact with the ink line to provide the desired height;

heating the substrate over an amount of time sufficient to entirely melt and fuse the large granulation powder to yield a smooth surface, yet insufficient to cause overmelting flattening of the large granulation powder; and cooling the fused large granulation powder sufficiently to avoid flattening, sticking, or smearing of the fused powder, thereby obtaining the raised thermographic print.

7. The raised thermographic product of claim 6, wherein the substrate comprises paper.

8. The raised thermographic print of claim 6, having a line width of about 1/16 to 1/8 inch.

9. A raised thermographic product comprising a substrate having raised smooth surface thermographic print thereon which is greater than 0.01 inches in height, wherein the print is about 1/16 to 1/8 inches in width.

10. The raised thermographic product of claim 9, wherein the substrate comprises paper.

11. The raised thermographic product of claim 9, wherein the raised thermographic print is formed as a border outline of a shape on the substrate.

* * * * *